US007117832B2

(12) United States Patent
Naumann et al.

(10) Patent No.: US 7,117,832 B2
(45) Date of Patent: Oct. 10, 2006

(54) DEVICE FOR ADJUSTING A CAMSHAFT OF AN INTERNAL COMBUSTION ENGINE OF A MOTOR VEHICLE

(75) Inventors: Ralf Naumann, Crimmitschau (DE); Gerold Sluka, Nürtingen (DE); Andreas Knecht, Kusterdingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 0 days.

(21) Appl. No.: 10/707,992

(22) Filed: Jan. 30, 2004

(65) Prior Publication Data

US 2005/0011481 A1 Jan. 20, 2005

(30) Foreign Application Priority Data

Feb. 1, 2003 (DE) ..... 103 03 991

(51) Int. Cl.
*F01L 1/34* (2006.01)

(52) U.S. Cl. ..... 123/90.17; 123/90.31; 123/90.12; 74/567; 74/568 R; 29/888.1; 464/1; 464/2; 464/160

(58) Field of Classification Search ..... 123/90.12, 123/90.15–90.17, 90.27, 90.31; 74/567, 74/568 R; 29/888.1, 464, 466; 464/1, 2, 464/160

See application file for complete search history.

(56) References Cited

U.S. PATENT DOCUMENTS

| | | | | |
|---|---|---|---|---|
| 5,495,776 | A | 3/1996 | Allen | 74/395 |
| 5,823,152 | A | 10/1998 | Ushida | 123/90.17 |
| 6,006,708 | A | 12/1999 | Ken et al. | 123/90.17 |
| 6,176,210 | B1 * | 1/2001 | Lichti et al. | 123/90.17 |
| 6,305,242 | B1 * | 10/2001 | Smith et al. | 74/567 |
| 6,311,656 | B1 * | 11/2001 | Watanabe | 123/90.17 |
| 6,363,896 | B1 * | 4/2002 | Speier | 123/90.17 |
| 6,382,157 | B1 | 5/2002 | Yamauchi et al. | 123/90 |
| 6,505,585 | B1 * | 1/2003 | Machida et al. | 123/90.17 |
| 6,684,834 | B1 * | 2/2004 | Kohrs | 123/90.17 |
| 2002/0000213 | A1 * | 1/2002 | Fukuhara et al. | 123/90.17 |

FOREIGN PATENT DOCUMENTS

WO WO 9954599 A1 * 10/1999

* cited by examiner

*Primary Examiner*—Thomas Denion
*Assistant Examiner*—Kyle M. Riddle
(74) *Attorney, Agent, or Firm*—Gudrun E. Huckett

(57) ABSTRACT

A device for adjusting a camshaft of an internal combustion engine of a motor vehicle has a stator and a rotor fixedly connected to a camshaft and rotatable relative to the stator. A drive wheel is fixedly connected to the stator and is centered by the camshaft. The stator has a peripheral area provided with a centering element interacting with a counter element provided on the drive wheel for aligning the drive wheel in a rotational direction relative to the stator.

5 Claims, 5 Drawing Sheets

36
33
30
1
6
32
4
31
3
2
38
34
39
37

VI
2
30
1
6
34
4
VI 30
34
14
31

37
30
34
38
40
14
32
31
4

DEVICE FOR ADJUSTING A CAMSHAFT OF AN INTERNAL COMBUSTION ENGINE OF A MOTOR VEHICLE

BACKGROUND OF INVENTION

1. Field of the Invention

The invention relates to a device for adjusting a camshaft of an internal combustion engine of a motor vehicle, wherein the device comprises a stator and a rotor that is rotatable relative to the stator and is connected fixedly to the camshaft. At least one drive wheel is provided that is fixedly connected to the rotor.

2. Description of the Related Art

A known adjusting device (FIG. 2) comprises a stator 1 surrounding a rotor 4. The rotor 4 is fixedly connected to a camshaft 5 so as to rotate with the camshaft. Moreover, a drive wheel 30 that is embodied as a chain wheel is mounted on the rotor 4. The rotor 4 has a collar 4*a* for receiving the drive wheel 30. This collar 4*a* projects axially past the end face of the rotor. The manufacture of the collar 4*a* is complex and expensive because it must be produced by turning. For aligning the drive wheel 30 relative to the stator 1, centering or positioning elements 34 are provided that engage bores in the drive wheel 30 and the stator 1. The manufacture of these centering bores is also complex and expensive.

SUMMARY OF INVENTION

It is an object of the present invention to provide a device of the aforementioned kind that can be produced simply and inexpensively.

In accordance with the present invention, this is achieved in that the drive wheel is centered by the camshaft. In one particular embodiment, the stator is provided on its peripheral area with at least one centering element that interacts with at least one counter element of the drive wheel and that aligns the drive wheel in the rotational direction relative to the stator.

In the device according to the invention, the drive wheel is centered by the camshaft so that, in this way, the rotor can be of a very simple configuration. In particular, the rotor must not be provided with a collar. Therefore, it can have essentially two plane end faces that, after conventional sintering processes of the rotor, can be finish-machined by a simple grinding process.

In one specific embodiment, the drive wheel is aligned in the rotational direction relative to the stator by the centering element and the counter element interacting with the centering element. The centering element is provided in the peripheral area of the stator so that the stator must not be provided with centering bores. The same holds true also for the drive wheel that, as a result of the counter element, does not require a centering bore. In this way, the stator can be produced in a simple way as a sintered part.

DETAILED DESCRIPTION

Figure 1:
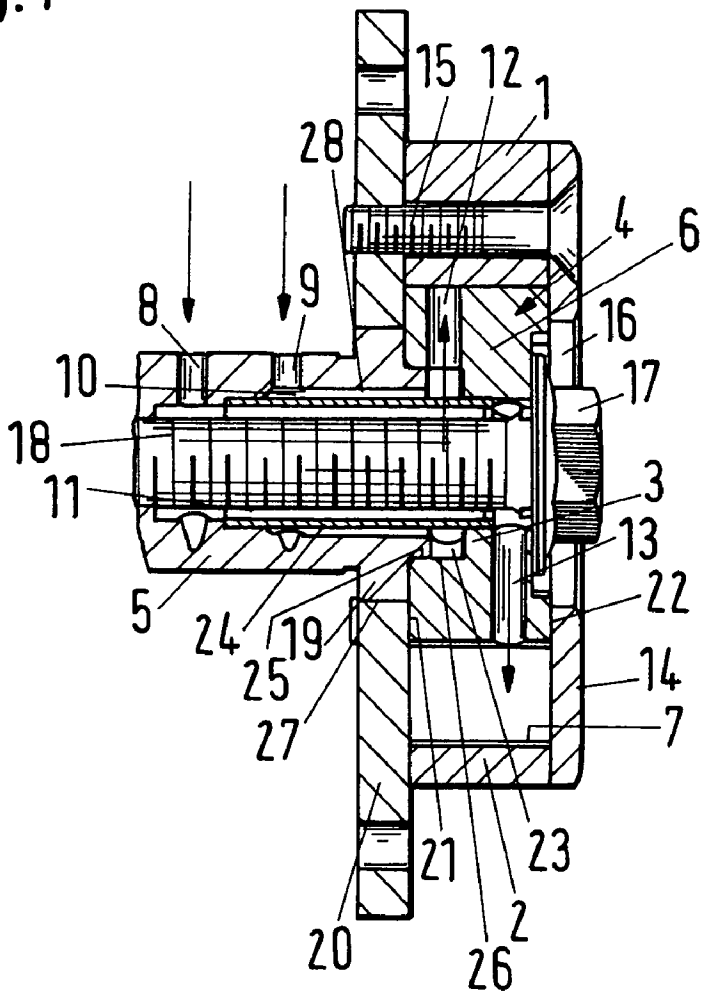
FIG. 1 is an axial section of the adjusting device according to the present invention.
Figure 2:
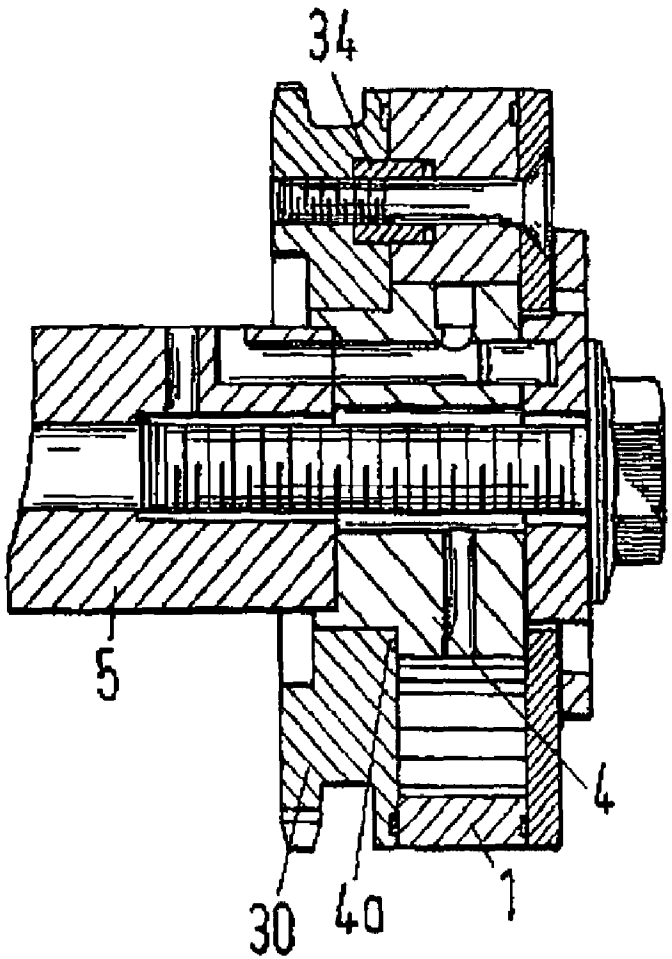
Fig.2 PRIOR ART
FIG. 2 shows an adjusting device of the prior art in a representation corresponding to FIG. 1.

In the following embodiments, like parts are referenced with like reference numerals.

The adjusting device described herein is a camshaft adjuster with which, as is known in the art, a camshaft of an internal combustion engine of a motor vehicle can be adjusted. Since the configuration of such an adjusting device is known in the art, it will be explained only briefly in the following. It comprises a stator 1 having a cylindrical peripheral wall 2 and stays (not illustrated) projecting radially inwardly from the wall 2. Pressure chambers are formed between the stays. The stays are positioned with their end faces sealingly against the base member 3 of a rotor 4 that is fixedly attached to the camshaft 5. Radial vanes 6 project from the rotor base member 3 and rest sealingly with their end faces against the inner wall 7 of the peripheral stator wall 2. In each one of the pressure chambers of the stator 1, one vane is positioned whose width is smaller than the spacing between the sidewalls of the stator stays that delimit the pressure chamber, respectively. The rotor 4 can be rotated relative to the stator 1 to such an extent that the rotor vanes 6, depending on the rotational direction, come to rest against one of the two limiting sidewalls of the pressure chambers of the stator 1. Both sides of the rotor vanes 6 can be loaded by a pressure medium as needed for the desired rotational direction of the rotor 4 relative to the stator 1. For this purpose, the pressure medium, controlled by at least one valve (not illustrated), is supplied via bores 8 and 9 in the camshaft 5. Through the radial bores 8, 9, the pressure medium flows into axially extending supply lines 10, 11 in the camshaft 5. Via these supply lines 10, 11, the pressure medium is conveyed by radially extending bores 12, 13 to the selected side of the rotor vanes 6.

A cover plate or disk 14 rests against one end face of the stator wall 2. It is fastened on the stator 1 by means of screws or threaded bolts 15 that are distributed peripherally about the disk 14. The outer diameter of the cover plate 14 corresponds to the outer diameter of the stator wall 2. The cover plate 14 projects radially past the rotor base member 3 and has a central opening 16 in which the screw head 17 of a screw 18 is positioned. The screw 18 fixedly connects the rotor 4 and the camshaft 5.

The camshaft 5 is provided with a radially outwardly projecting collar 19 positioned at a spacing from its free end. A flange 20 is arranged on the collar 19. It is connected to the stator 1 by screws 15 distributed about its periphery.

The rotor 4 or its base member 3 has two plane end faces 21 and 22. The rotor 4 is advantageously a sintered part. After sintering the rotor, the two plane end faces 21, 22 of the rotor 4 can be finish-machined by a simple grinding process. The rotor 4 rests with the end face 22 against the cover disk or plate 14. The opposite end face 21 is provided with a central recess 23 that serves for centering the rotor 4 on the camshaft 5. A sleeve 24 serves for separating the supply lines 10 and 11. The camshaft 5 is advantageously configured as a monolithic part supporting the collar 19. By means of the end projecting past the collar 19, the camshaft 5 rests with its outer peripheral surface 25 against the inner wall 26 of the recess 23 of the rotor 4. In this way, the camshaft 5 is aligned radially in a simple way relative to the rotor 4. The axial alignment is realized by contact of the collar 19 on the plane end face 21 of the rotor 4.

The recess 23 in the rotor 4 can be produced during the sintering process so that a subsequent machining of this central recess 23 in the rotor 4 is not required. The chain wheel (not illustrated) is centered via the flange 20 by means of the camshaft 5. It is also possible that the flange 20 itself is embodied as a chain wheel. The collar 19 serves as a bearing 27 for the flange 20. In this way, radial forces caused by the drive action can be compensated and the friction between the rotor 4 and the stator 1 can be minimized.

The camshaft 5 has an inner diameter that is greater than the outer diameter of the screw 18. An annular chamber 28 is formed in this way, and the sleeve 24 is inserted into the annular chamber 28 and divides the annular chamber 28 into the two supply lines 10 and 11 for the pressure medium. These supply lines 10, 11 are thus annular chambers, separated from one another by the sleeve 24.

Figure 3:
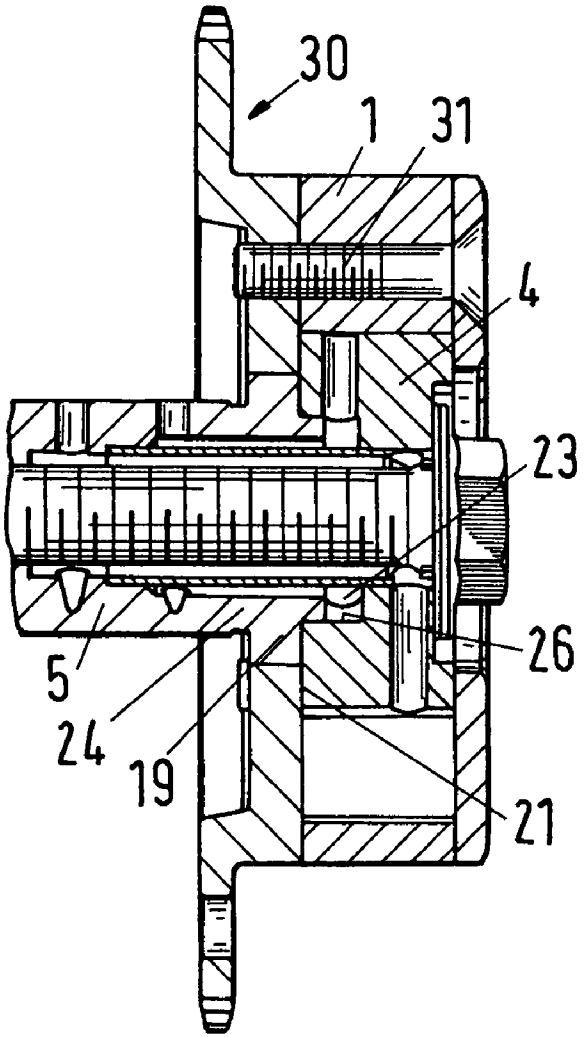
FIG. 3 shows in a representation corresponding to FIG. 1 a second embodiment of the adjusting device according to the present invention.

FIG. 3 shows an adjusting device in the form of a camshaft adjuster. In this embodiment, a drive wheel in the form of a chain wheel 30 is positioned on the radial outer circumference of the collar 19 of the camshaft 5. As in the preceding embodiment, the radial centering of the rotor 4 relative to the camshaft 5 is realized in that the camshaft 5, by means of the end projecting axially past the collar 19, rests against the inner wall 26 of the recess 23 in the end face 21 of the rotor 4. The chain wheel 30 is advantageously screwed onto an end face of the stator 1 by means of threaded bolts 31 that are advantageously distributed circumferentially about the stator 1.

Figures 4, 5, 6, 7:
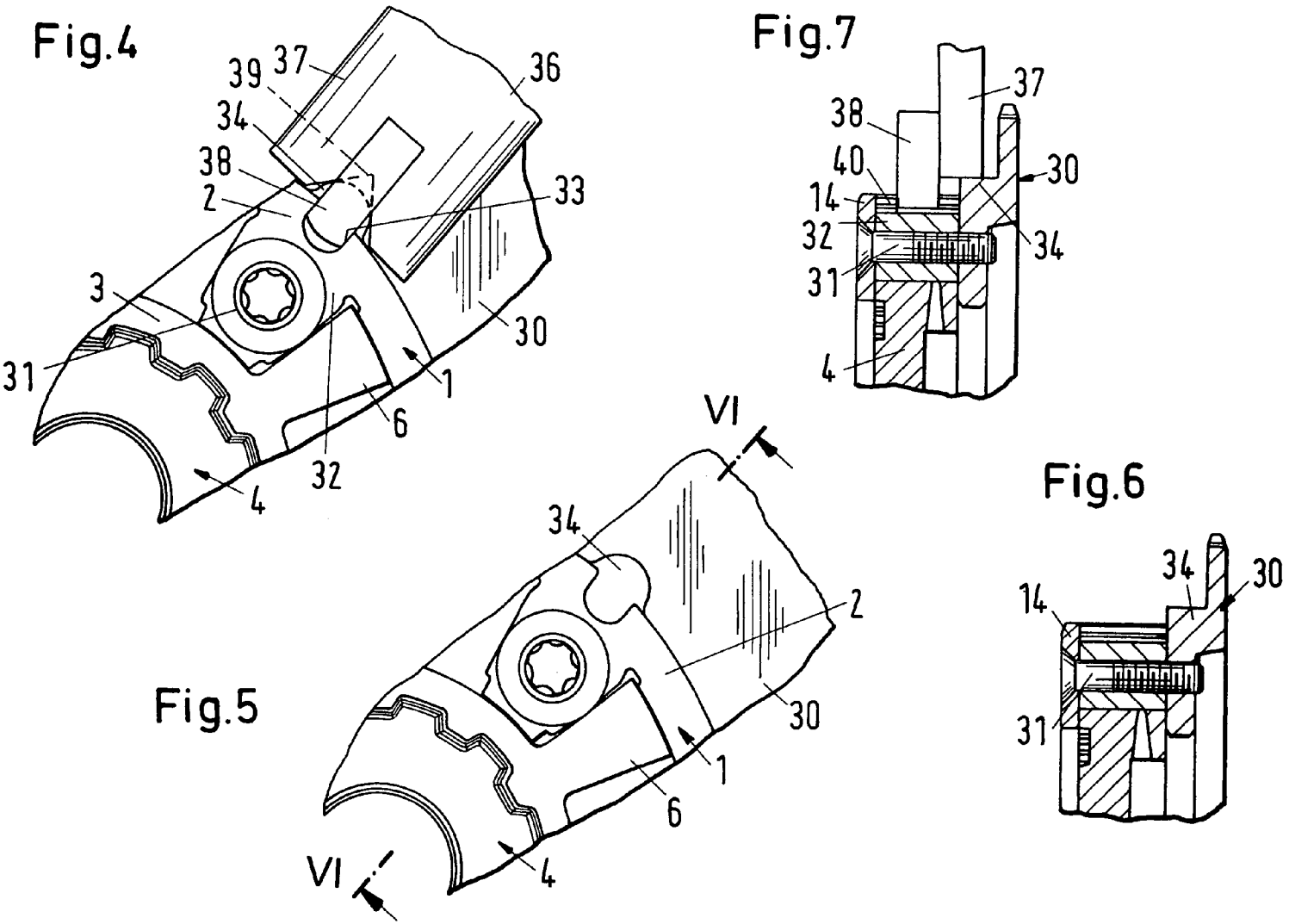
FIG. 4 is a detail view in the axial direction of the adjusting device according to the present invention during mounting.
FIG. 5 shows in an illustration corresponding to FIG. 4 the finish-mounted adjusting device.
FIG. 6 is a section along the line VI—VI of FIG. 5.
FIG. 7 shows an axial section view of a detail of the mounting tool and of the adjusting device of FIG. 4.

Independent of the radial centering action of the rotor 4 relative to the camshaft 5, the alignment of the chain wheel 30 is realized relative to the stator 1. This will be explained in more detail with the aid of FIGS. 4 through 7. In FIG. 4, one of the stays 32 of the stator 1 can be seen that rests with its end face on the base member 3 of the rotor 4. One of the rotor vanes 6 is illustrated in FIG. 4, it rests with one lateral surface on one of the sidewalls of the stay 32. At least some of the stator stays 32 are penetrated by a threaded bolt 31, respectively, with which the chain wheel 30 is connected fixedly to the stator 1.

In order to be able to align the chain wheel 30 in the circumferential direction relative to the stator 1, at least one centering element 33 is provided on the peripheral wall 2 of the stator. In the illustrated embodiment, the centering element 33 is a recess within the outer surface of the wall 2. The chain wheel 30 is provided with a counter element (positioning element) 34.

For an exact alignment of the chain wheel 30 in the circumferential direction relative to the stator 1, a mounting tool 36 is used. It has a base plate 37 on which an alignment element 38 is provided. The base plate 37 has a triangular recess 39. When positioning the mounting tool 36 on the stator 1, the positioning element 34 in the form of a shoulder of the chain wheel 30 engages the triangular recess 39. As a result of the triangular configuration of the recess 39, the positioning element 34 and thus the chain wheel 30 are aligned relative to the stator 1 in the rotational direction. Moreover, the alignment element 38 of the mounting tool 36 engages an alignment element in the form of a groove 40 that is provided in the outer side of the wall 2 of the stator 1 and extends axially between the cover plate 14 and the chain wheel 30 (FIG. 7). The threaded bolts 31 can be mounted very easily, and the cover plate or disk 14, the stator 1 and the chain wheel 30 are connected securely with one another by means of the bolts 31.

Since, as described above, by means of the positive-locking element 34 and the groove-shaped centering element 33, the alignment of the stator 1 and of the chain wheel 30 is realized in the circumferential direction, the stator 1 can be produced in a simple and inexpensive way as a sintered part. After sintering, only the contact side of the stator 1 relative to the chain wheel 30 must be machined, preferably, by grinding.

The alignment element 38 is advantageously spring loaded so that centering in the circumferential direction between the stator 1 and the chain wheel 30 can be realized independent of the radial orientation of the chain wheel 30 relative to the rotor 4.

Figure 8:
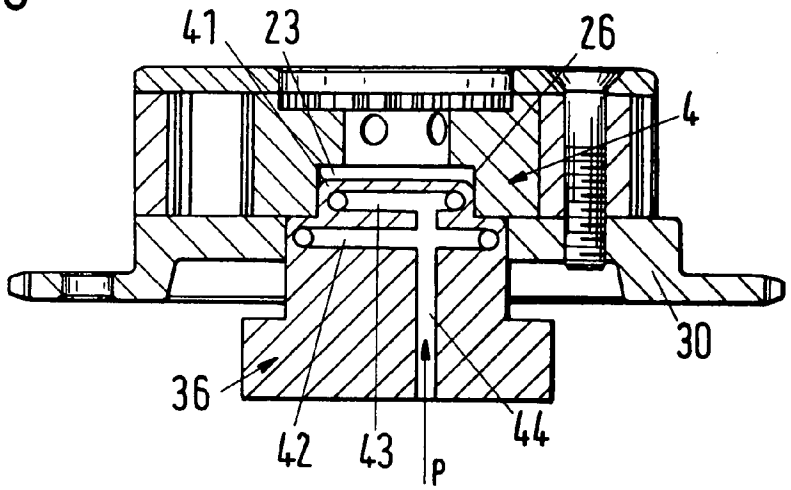
FIG. 8 is an axial section of an adjusting device according to the present invention during mounting.

FIG. 8 shows the possibility of aligning the chain wheel 30 radially relative to the rotor 4. In this case, the mounting tool 36 is a centering pin that has a stepped configuration in cross-section. The stepped configuration is designed such that the chain wheel 30 rests on the centering pin 36 and the centering pin 36, in turn, rests with its narrow end 41 on the inner wall 26 of the recess 23 provided in the end face of the rotor 4. At the level of contact of the chain wheel 30 and of the inner wall 26, the centering pin 36 is provided with expansion chambers 42, 43 which receive via supply line 44 a pressure medium. In the area of the expansion chambers 42, 43, the centering pin 36 has a wall that is so thin that it can be elastically widened when subjected to the pressure of the medium. In this way, any play between the centering pin 36 and the chain wheel 30 or the rotor 4 is compensated. In this way, the chain wheel 30 can be simply and precisely aligned radially relative to the rotor 4.

Figure 9:
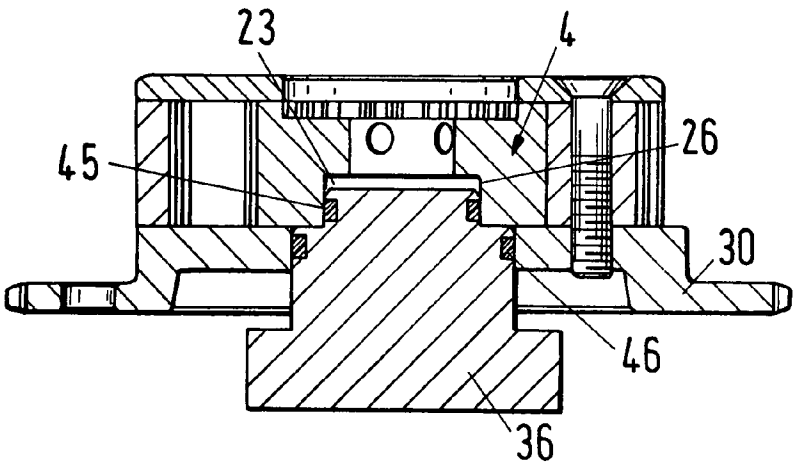
FIG. 9 is an axial section of a further embodiment of the adjusting device according to the present invention during mounting.

FIG. 9 shows a mounting tool in the form of a centering pin 36; however, in this embodiment no expansion chambers 42, 43 are provided. Instead, at the level of the chain wheel 30 as well as of the inner wall 26 of the recess 23 in the end face of the rotor 4, an annular play compensation element 45, 46 is provided, respectively. This play compensation elements 45, 46 can be O-rings, hose-shaped rings with pressure loading or the like and are arranged in corresponding circumferential grooves of the centering pin 36. Possibly present play between the centering pin 36 and the chain wheel 30 as well as the rotor 4 is compensated by elastic deformation of the play compensation elements 45, 46.

In the described embodiments, the camshaft 5 is inserted into the recess 23 of the rotor 4 and fixedly connected with this end to the rotor. For this purpose, any suitable connection between the camshaft and rotor can be provided. In order for the adjusting device to be suitable also for already present camshafts that do not project into the rotor, it is possible to employ adapters that in this case connect the camshaft to the rotor 4 by a fixed connection. In such a case, the pressure medium for rotating the rotor 4 relative to the stator 1 can be supplied through the adapter. This has the advantage that the camshaft itself does not require any special machining or configuration.

Instead of the chain wheel 30, gear wheels or pulleys can also be employed as drive members in the described camshaft adjusters.

While specific embodiments of the invention have been shown and described in detail to illustrate the inventive principles, it will be understood that the invention may be embodied otherwise without departing from such principles.

What is claimed is:

1. A device for adjusting a camshaft of an internal combustion engine of a motor vehicle, the device comprising:

a stator;

a rotor configured to be fixedly connected to a camshaft and rotatable relative to the stator;

at least one drive wheel fixedly connected to the stator;

wherein the at least one drive wheel is centered by the camshaft;

wherein the stator has a peripheral area provided with at least one centering element interacting with at least one counter element provided on the drive wheel for aligning the drive wheel in a rotational direction relative to the stator.

2. The device according to claim 1, whereIn the centering element is a recess in a peripheral wall of the stator.

3. The device according to claim 1, wherein the counter element is a shoulder provided on the drive wheel and engaging the centering element.

4. The device according to claim 1, wherein the stator has at least one alignment element interacting with at least one alignment element of a mounting tool for radially aligning the drive wheel relative to the rotor.

5. The device according to claim 4, wherein the at least one alignment element of the stator is an axially extending groove in a peripheral wall of the stator.

* * * * *